United States Patent [19]

Blümle

[11] Patent Number: 4,896,480

[45] Date of Patent: Jan. 30, 1990

[54] METHOD AND APPARATUS FOR PLACING A COVER ON A BOX

[75] Inventor: Martin Blümle, Horhausen, Fed. Rep. of Germany

[73] Assignee: Winkler & Dunnebier Maschinenfabrik und Eisengiesserei KG, Neuwied, Fed. Rep. of Germany

[21] Appl. No.: 301,807

[22] Filed: Jan. 25, 1989

[30] Foreign Application Priority Data

Mar. 1, 1988 [DE] Fed. Rep. of Germany ..... 3806512

[51] Int. Cl.[4] ..... B65B 7/28

[52] U.S. Cl. ..... 53/485; 53/313; 53/316

[58] Field of Search ..... 53/281, 282, 313, 314, 53/315, 316, 471, 485

[56] References Cited

U.S. PATENT DOCUMENTS

| | | | |
|---|---|---|---|
| 2,188,759 | 1/1940 | Redd | 53/313 |
| 2,971,306 | 2/1961 | Phillips | 53/313 |
| 3,124,916 | 3/1964 | Anderson et al. | 53/471 |
| 3,261,142 | 7/1966 | Wilcox | 53/314 |
| 3,383,834 | 5/1968 | Switliski et al. | 53/315 |
| 4,122,649 | 10/1978 | Sawvel | 53/314 X |
| 4,312,172 | 1/1982 | Fisher et al. | 53/314 X |
| 4,345,413 | 8/1982 | McCranie et al. | 53/315 |

*Primary Examiner*—John Sipos
*Assistant Examiner*—Linda B. Johnson
*Attorney, Agent, or Firm*—Collard, Roe & Galgano

[57] ABSTRACT

A method and apparatus for placing a cover on a box is provided wherein the box cover is first lowered inclined and placed on the opening of a moving box such that its edge leading in the direction of motion grips across the edge of the opening of the box leading in the direction of motion, and its edge trailing in the direction of motion, which edge is inclined upwardly, remains supported. The box is moved or advanced in the direction of motion so that the box pulls the cover from the support supporting the trailing edge of the cover and the latter places itself on the opening of the box. Pressure is then applied to the cover from above in order to completely force the cover over the edges of the opening of the box.

7 Claims, 3 Drawing Sheets

METHOD AND APPARATUS FOR PLACING A COVER ON A BOX

The present invention relates generally to a method and apparatus for placing or positioning a cover on a box and, more particularly, it relates to a method and apparatus for placing a cover on a box for use in high speed automated machinery.

A method and apparatus of this general type are basically known and available from manufacturers that produce this type of equipment. The known apparatus comprises a cover magazine from which the covers are individually taken from the lower end, displaced sideways and subsequently placed on the boxes being fed by pushing the boxes into the covers from below. In the raised position, the box is subsequently supported by swivel-mounted holders so that the next cover and the next box can be brought into the cover placement or lifting station. The boxes so fitted with covers are stacked directly on top of the cover placement station and finally removed.

This known process and the apparatus associated therewith basically operate satisfactorily. However, this process and apparatus operates on an intermittent work cycle and problems arise if the cover or the edges thereof are not aligned with absolute exactness with the edges of the opening of the box, or if the cover is slightly set on edge. This means that very close tolerances must be maintained.

It is therefore, a primary object of the present invention to provide a method and apparatus for placing covers on boxes which involve a simple design and, furthermore, are largely insensitive to problems stemming from inaccuracies in alignment between the cover and the box, and which permit continuous operation.

The above object is accomplished in accordance with the present invention by first lowering the cover in an inclined attitude and placing it on the opening of a moving box in such a way that the lower edge of the cover leading in the direction of movement grips over the edge of the box opening leading in the direction of motion, and the edge of the cover trailing in the direction of motion, which edge is inclined so as to project upwardly, remains supported. The box then moves in the predetermined direction so that it pulls the cover from the support supporting the trailing edge of the cover, and the cover drops on the opening of the box. Pressure is then applied to the cover from above in order to completely force the cover over the edges of the opening of the box.

In this method, the cover is seized on a first side while it is still in the magazine, and then moved downwardly only on that side until it comes to rest on the box substantially aligned with the latter. Thereafter, the box is moved against the cover, which is in an inclined position, so that the box pulls the cover from the magazine and the cover completely drops onto the opening of the box. All these movements can be carried out continuously since the box is moved only in a single direction. According to this method, the box runs from one side into a position beneath the magazine and it leaves this position again on the other side of the magazine. If all the cycles of motion are precisely coordinated and synchronized, a continuous or nearly continuous operation results.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
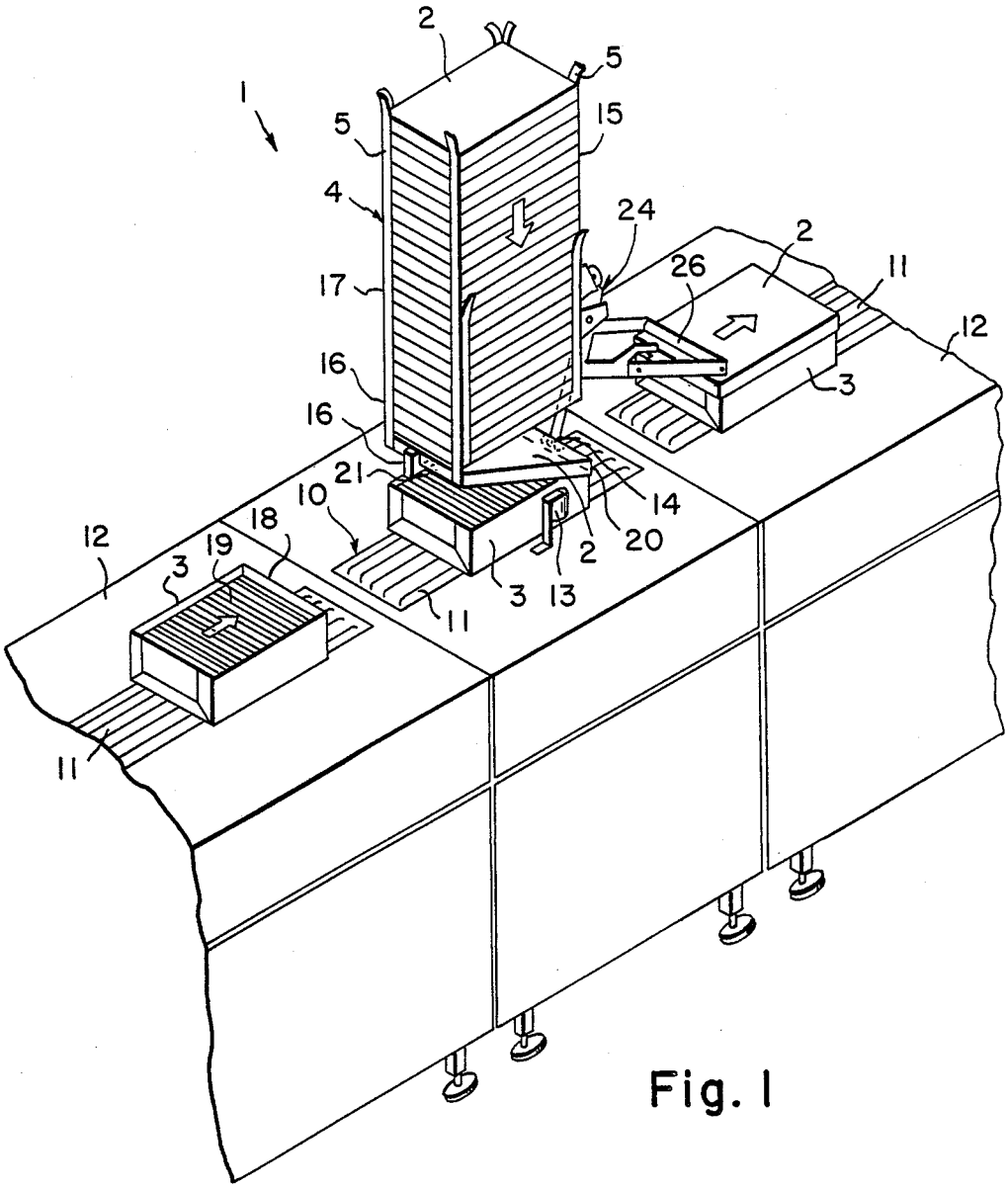
FIG. 1 is a perspective view of a schematic representation of the apparatus for placing a cover on a box, according to the present invention.
Figure 3:
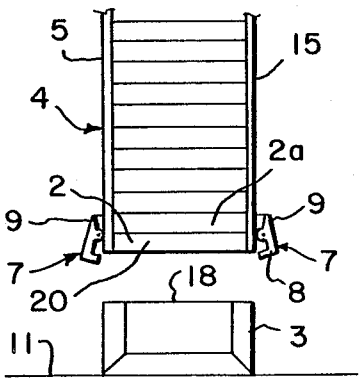
FIG. 3 is a schematic front view of the magazine and the box, showing the release of the lowermost cover to be placed on the box.
Figure 5:
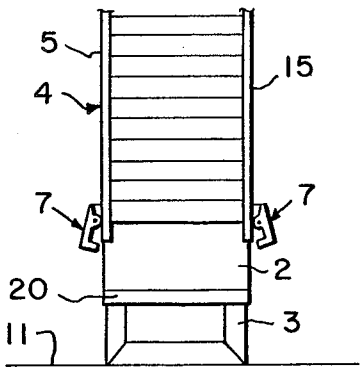
FIG. 5 is a front view of the magazine, the cover and the box in the position shown in FIG. 4.
Figure 2:
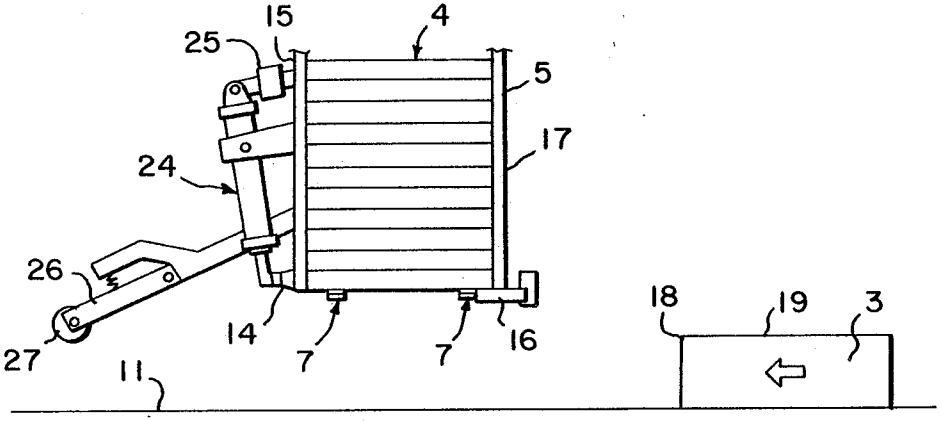
FIG. 2 is a schematic side view of a box before the latter reaches the station in which the cover is placed on the box.
Figure 4:
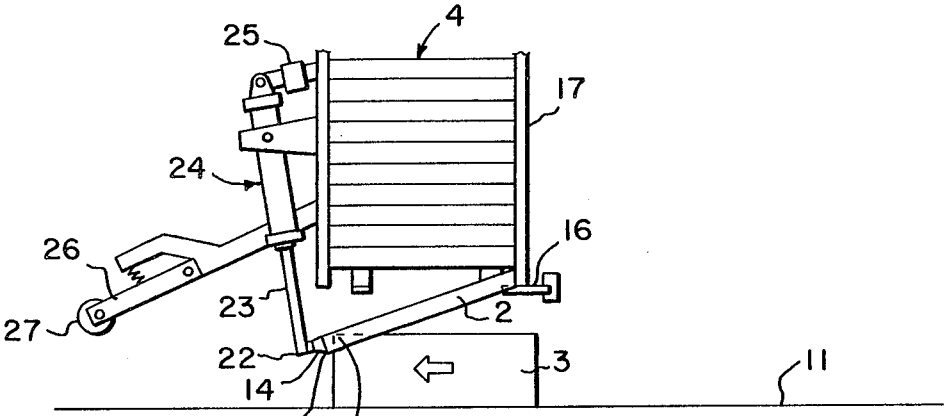
FIG. 4 is a side view similar to FIG. 2, showing the cover after it has been partially placed on the box.
Figure 7:
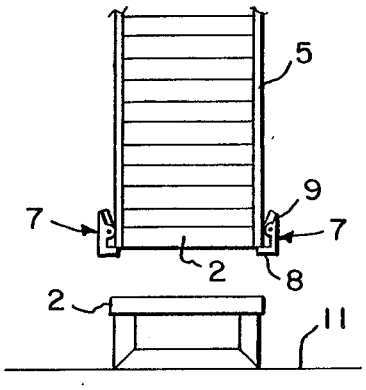
FIG. 7 is a front view of the magazine and the box with the cover thereon.
Figure 6:
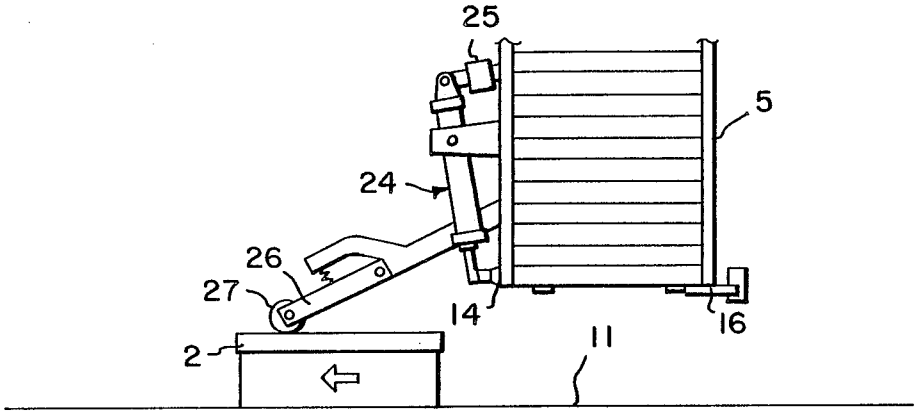
FIG. 6 is a side view of the apparatus as shown in FIGS. 2 and 4 showing the step of forcing the cover onto the box.

Now turning to the drawings, there is shown in FIG. 1 an apparatus 1 for placing a cover 2 on a box 3 which includes a cover magazine 4. Between the holding and guiding columns 5 of magazine 4, several stacked covers 2 are freely movable in the direction of the arrow, the covers being separated into single units at the lower end 6 of the magazine. For supporting and separating covers 2 into single units in cover magazine 4, provision is made for swivel-mounted separating fingers 7, which, in accordance with FIG. 7, either grip under the lowermost cover 2 with a projection 8, or, during release of cover 2, with a contact pressure element 9 as shown in FIG. 3, clamp cover 2*a* disposed above cover 2 to be released, between each other, thereby preventing the entire stack of covers from sliding down. Separating fingers 7 are shown in FIGS. 2 to 7, but are not shown in FIG. 1 for the sake of clarity.

Cover magazine 4 is arranged with a spacing above a transporting device 10 for conveying boxes 3. As seen in FIG. 1, transporting device 10 may be comprised of a number of conveyor belts 11 arranged in series one after the other in the direction of transport and integrated in each case in separate tables 12. With the help of lateral guide rollers 13, boxes 3 are aligned laterally beneath cover magazine 4, as clearly seen in FIG. 1.

The device or system for separating covers 2 into single units and for lowering such covers and placing them on boxes 3, however, not only comprises separating fingers 7 required for dividing the covers into single units, but additionally, at least one lowerable cover support 14 on one side 15 of cover magazine 4, and a fixed cover support 16 on the opposite side 17 of cover magazine 4. As soon as separating fingers 7 release lowermost cover 2 in cover magazine 4 by swinging back projections 8, the cover only rests on fixed cover support 16 and the lowerable cover support 14. By lowering cover support 14, cover 2 is moved into an inclined position, as clearly seen in FIGS. 1 and 4, so that cover 2 comes to rest on leading edge 18 of box opening 19 and box 3, with its leading edge 18, at the same time moves under cover edge 20, the latter leading in the direction of movement. Edge 21 of cover 2, the latter trailing in the direction of movement, remains supported at this point in time by fixed cover support 16 (cf. FIGS. 1 and 4).

As box 3 advances in the direction of motion of conveyor belt 11 in the direction of the arrow, box 3 pulls trailing edge 21 of cover 2 from fixed cover support 16, causing cover 2 to completely slide onto opening 19 of the box, whereby cover support 14 can still apply a certain pressure to leading edge 20 of the cover in order to favorably influence the motion by which cover 2 slides onto opening 19 of the box.

Preferably, lowerable cover support 14 is a suction holder, of which the figures show only the suction cup. The figures do not show the associated vacuum lines, vacuum generator and the system for controlling these elements. This applies to the drives and controls of separating fingers 7 as well.

As soon as cover 2 is placed on box 3, lowerable cover support 14 releases cover 2 and removes itself from the path of movement of box 3. In order to accomplish such a movement of lowerable cover support 14, the latter or its suction device is arranged on free end 22 of piston rod 23 of a swivel-mounted piston-cylinder device 24. Device 24 is swivel-mounted as well and swivelled by means of a drive 25, which may also be a piston-cylinder device.

As soon as cover 2 rests on box 3, cover support 14 detaches itself from cover 2 and swivels forward or upward in the direction of movement, so that box 3 with cover 2 can advance without interference. As it advances it reaches a device 26, by means of which a pressure is applied to cover 2. Device 26 comprises a liftable contact pressure roll 27, against which box 3 with its cover 2 runs as shown by comparing FIGS. 2, 4 and 6.

Lowerable cover support 14, fixed cover support 16 and device 26 are preferably arranged directly on cover magazine 4, as shown schematically in the figures.

According to the invention, the method of placing cover 2 on box 3 is substantially carried out in that cover 2 is seized while still in the cover magazine on a side corresponding with leading edge 20 of the cover and subsequently moved down with that side as the leading edge, whereby box 3 simultaneously runs into cover 2, which has assumed an inclined position, and pulls the cover from cover magazine 4 as it moves on, whereupon the cover drops onto opening 19 of the box. Device 26 then assures that cover 2 is firmly pressed onto box 3.

While only a single embodiment of the present invention has been shown and described, it will be obvious that many changes and modifications may be made thereunto without departing from the spirit and scope of the invention.

What is claimed is:

1. A method of placing a cover on a moving box having an opening, comprising:

(a) lowering the cover so that it is inclined with the edge thereof trailing in the direction of the box movement remaining supported by seizing the cover on one side while in a cover magazine and moving the cover downwardly with said side leading so that the cover is in an inclined position;

(b) gripping the edge of the cover leading in the direction of box movement over the leading edge of the box opening by running the box into the cover simultaneously with moving the cover downwardly;

(c) moving the box in the direction of box movement so that the box pulls the cover from the magazine supporting the trailing edge thereof, whereby the cover is placed on the opening of the box; and (d) applying pressure to the cover from above so as to completely force the cover over the edges of the box opening.

2. The method as defined in claim 1, wherein as the cover is placed on the box, the box moves in a straight line in the direction of transport.

3. Apparatus for placing a cover on a box, comprising:

(a) a cover magazine having at least a first side and an oppositely disposed second side (b) cover feeding means including a plurality of swivel-mounted separating fingers, at least one lowerable cover support having at least one moveable suction holder on said first side of said cover magazine and a fixed cover support on said second side of said cover magazine; and (c) transporting means for transporting said box beneath said cover magazine.

4. The apparatus as defined in claim 3, wherein said suction holder is disposed at the free end of a piston rod of a swivel mounted piston-cylinder device.

5. The apparatus as defined in claim 3, wherein said lowerable cover support and said fixed cover support are arranged on the cover magazine.

6. The apparatus as defined in claim 3, which further comprises means for applying pressure to the cover subsequent to placing the cover on the box.

7. The apparatus as defined in claim 6, wherein said means for applying pressure to the cover comprises a liftable contact pressure roll.

* * * * *